US005661859A

United States Patent [19]

Schaefer

[11] Patent Number: 5,661,859

[45] Date of Patent: Sep. 2, 1997

[54] SHOULDER ARTHOSCOPY ATTACHMENT

[75] Inventor: James A. Schaefer, Versailles, Ohio

[73] Assignee: Midmark Corporation, Versailles, Ohio

[21] Appl. No.: 546,275

[22] Filed: Oct. 20, 1995

[51] Int. Cl.[6] ..... A61G 13/00

[52] U.S. Cl. ..... 5/621; 5/622; 5/632; 5/633

[58] Field of Search ..... 5/617, 621, 622, 5/632, 633, 634, 630; 297/405, 406, 407, 410, 284.3, 486; 128/845

[56] References Cited

U.S. PATENT DOCUMENTS

| | | | |
|---|---|---|---|
| 332,836 | 12/1885 | Robinson et al. . | |
| 457,059 | 8/1891 | Stuck | 297/405 X |
| 2,898,169 | 8/1959 | Thompson et al. | 311/10 |
| 3,188,079 | 6/1965 | Boetcker et al. | 269/328 |
| 3,572,835 | 3/1971 | Kees, Jr. | 5/640 X |
| 3,828,377 | 8/1974 | Eary, Sr. | 5/632 |
| 3,913,155 | 10/1975 | Eary, Sr. | 5/632 |
| 3,946,952 | 3/1976 | Eary, Sr. | 5/632 |
| 4,271,830 | 6/1981 | Moon | 128/73 |
| 4,660,549 | 4/1987 | Kowalski et al. | 128/69 |
| 5,147,287 | 9/1992 | Jewell et al. | 602/32 |
| 5,208,928 | 5/1993 | Kuck et al. | 5/621 X |
| 5,275,176 | 1/1994 | Chandler | 128/845 |

*Primary Examiner*—Michael F. Trettel
*Attorney, Agent, or Firm*—Biebel & French

[57] ABSTRACT

A shoulder arthroscopy attachment for use with a surgical table wherein the attachment may be attached to a seat section of the table in place of an articulated leg section. The attachment includes a lumbar support assembly for supporting the lumbar portion of a patient's back, and a headrest assembly including an upper back support and a headrest. The upper back support is adjustable in a lateral direction whereby either of a patient's shoulders may be exposed for an operation while supporting the opposite shoulder on the upper back support. The headrest is adjustable relative to a frame for the headrest assembly whereby the head of a patient may be accommodated at a variety of positions.

17 Claims, 4 Drawing Sheets

SHOULDER ARTHOSCOPY ATTACHMENT

BACKGROUND OF THE INVENTION

The present invention relates to a surgical table attachment for performing shoulder arthroscopy operations, and more particularly, to a shoulder arthroscopy attachment which provides improved exposure of a patient's shoulder during an operation.

In recent years, an increasing number of shoulder arthroscopy operations have been performed as a preferred alternative to open surgery procedures. However, conventionally available surgical tables generally do not provide satisfactory exposure to the surgery area while conveniently supporting surrounding areas of the patient.

U.S. Pat. No. 5,275,176 discloses a proposed stabilization device for performing a shoulder arthroscopy operation. In this device, a surgical table is provided including a back support having right and left shoulder support cutout portions for selectively supporting the right and left shoulders of a patient. In order to perform a shoulder arthroscopy operation on one of the patient's shoulders, a shoulder cutout portion may be selectively removed from the bask support after the patient has been placed on the table in order to expose the shoulder for the operation.

While the known devices for shoulder arthroscopy operations facilitate such operations, there continues to exist a need for a patient support which provides improved exposure of the shoulder area and which is easily manipulated at the time the patient is positioned on the surgical table. In addition, there is a need for a shoulder arthroscopy attachment which may be used in combination with an existing multi-function surgical table whereby the capabilities of the surgical table are increased.

SUMMARY OF THE INVENTION

The present invention provides a shoulder arthroscopy attachment for use with a surgical table. The attachment comprises a lumbar support assembly and a headrest assembly wherein the lumbar support assembly includes a lower frame for attachment to an end of the surgical table and a lumbar support mounted on the lower frame for supporting the lumbar portion of a patient.

The headrest assembly includes an upper frame detachably mounted to the lower frame wherein the upper frame supports an upper back support. In addition, a headrest is adjustably mounted to the upper frame for supporting a patient's head.

The upper back support is mounted for movement in a lateral direction relative to the upper frame. Specifically, the upper back support is mounted for sliding movement to opposing lateral positions whereby either a right or left shoulder of a patient is exposed for a shoulder arthroscopy operation.

The attachment of the present invention is intended to be used in combination with a surgical table having a removable leg section. The lumbar support assembly is provided with an attachment portion for engagement with a receptacle portion defined on a seat section of the table whereby the attachment may be easily attached to and removed from the surgical table. In addition, the headrest preferably includes an adjustment mechanism having a pivoting ball joint to permit the headrest to be adjusted forwardly and rearwardly as well as in a lateral side to side direction.

Therefore, it is an object of the present invention to provide a shoulder arthroscopy attachment for selectively supporting a shoulder of a patient.

It is a further object of the invention to provide such an attachment wherein a movable upper back support is provided for selectively supporting the shoulder of a patient.

It is another object of the invention to provide a shoulder arthroscopy attachment wherein improved exposure of a patient's shoulder is provided for a shoulder arthroscopy operation.

Other objects and advantages of the invention will be apparent from the following description, the accompanying drawings and the appended claims.

DETAILED DESCRIPTION OF THE PREFERRED EMBODIMENT

Figure 1:
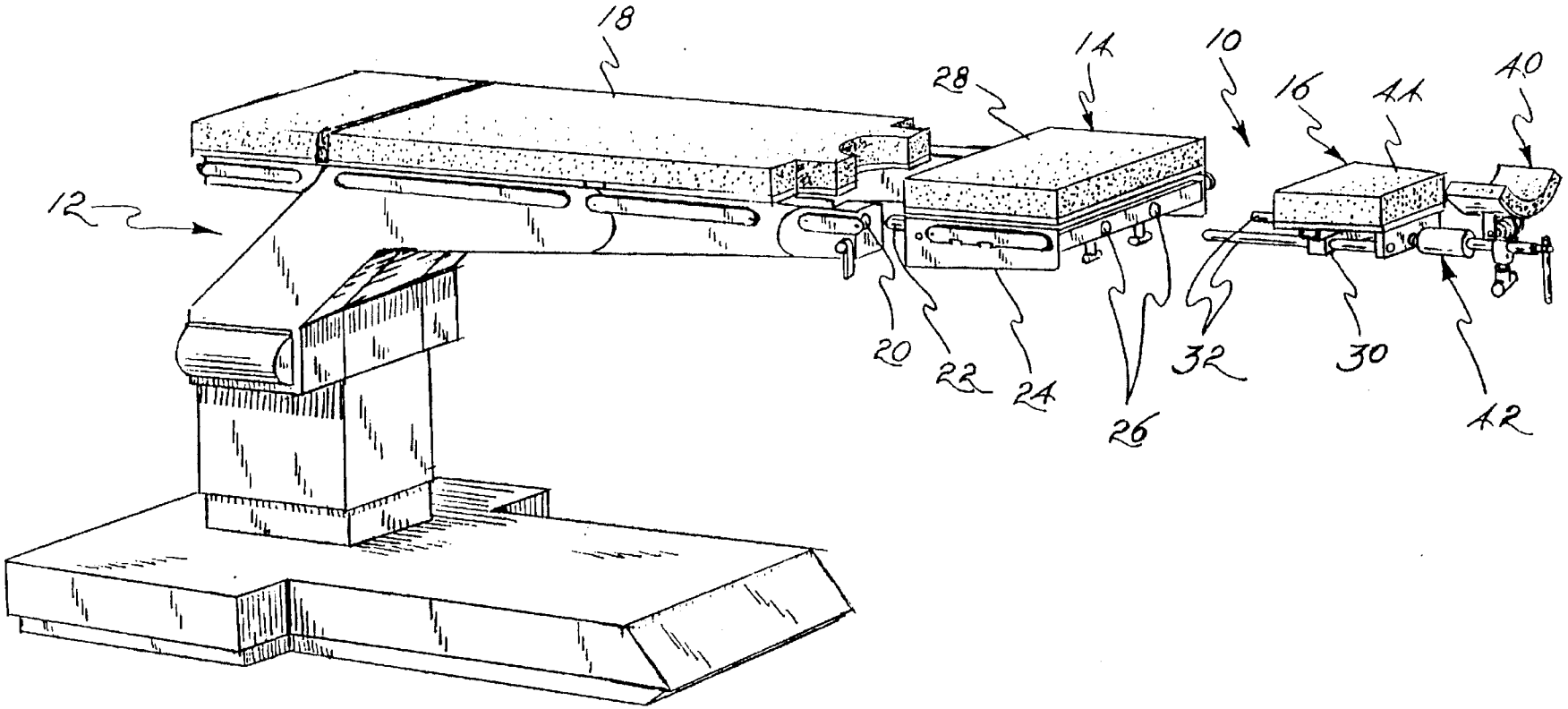
FIG. 1 is a perspective view illustrating assembly of the attachment of the present invention to a surgical table.

Referring to FIG. 1, the present invention comprises a shoulder arthroscopy attachment 10 for use with a surgical table 12. The attachment 10 generally includes a lumber support assembly 14 and a headrest assembly 16 wherein the lumbar support assembly 14 is adapted to support a lumbar portion of a patient and the headrest assembly 16 is adapted to support the upper back and head of a patient.

The attachment 10 is preferably adapted to be used with a surgical table 12 having an articulated seat section 18 including a pair of receptacles 20 (only one shown) which are normally configured to support a leg section for the table 12 in articulated relation to the seat section 18. For example, the surgical table 12 may be of the type disclosed in U.S. application Ser. No. 08/290,384, assigned to the assignee of the present invention and incorporated herein by reference.

Figure 2:
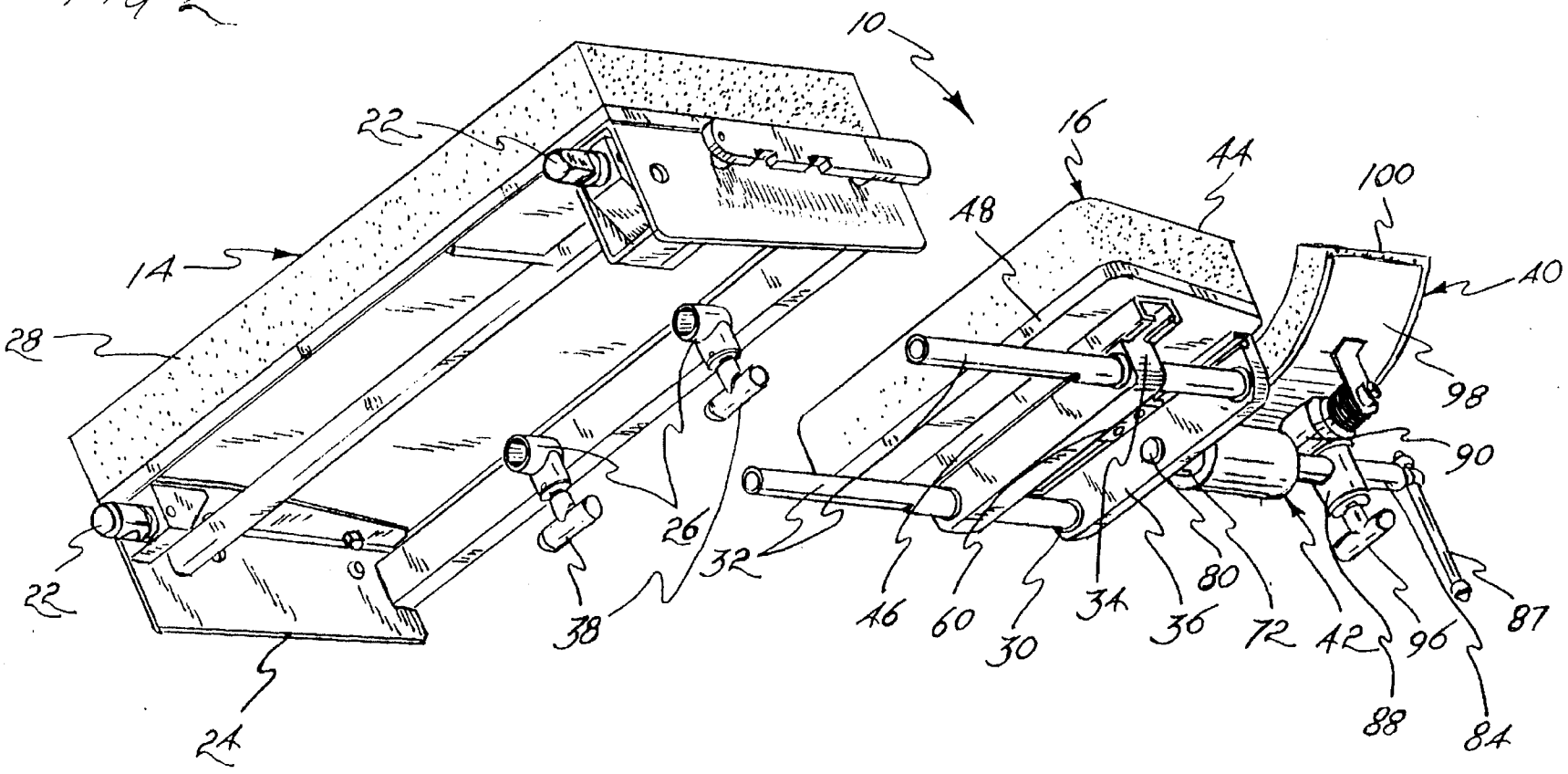
FIG. 2 is a perspective view of the lumbar support and headrest assemblies forming the attachment.

Referring further to FIG. 2, the lumbar assembly 14 includes a lumbar support cushion 28 for supporting the lumbar portion of a patient's back. The cushion 28 is supported on a lower frame 24 of the attachment 10, and a pair of attachment portion pins 22 are mounted to the frame 24 for engagement with the receptacles 20 of the seat section 18 to thereby mount the lumbar support assembly 14 to the surgical table 12. The pins 22 are mounted to a first longitudinal end of the lower frame 24 and a pair of sockets 26 are located at an opposing end of the frame 24.

The headrest assembly 16 includes an upper frame 30 defined by a pair of laterally opposed bar members 32 which are connected by a slide member 34 and a guide bar 36. The slide member 34 and guide bar 36 hold the bars 32 at a spacing which corresponds to the spacing of the sockets 26. Further, the slide member 34 and guide bar 36 are positioned along the bars 32 at predetermined spaced locations 64 and 66, respectively. The slide member 34 and guide bar 36 are held in position on the bars 32 by means of retaining rings 68 positioned adjacent to the areas 64, 66 (see FIG. 3). The bars 32 are mounted for longitudinal adjustment within the sockets 26 on the lumbar assembly 14. The sockets 26 further include socket T-handles 38 threadably engaged into the sockets 26 to lock the bars 32 into a desired position.

The headrest assembly 16 further includes a headrest 40 mounted for adjustment relative to the upper frame 30 by a ball joint adjustment mechanism 42. The adjustment mechanism 42 permits the headrest 40 to be adjusted forwardly or rearwardly, laterally side to side, and also rotationally about the longitudinal axis of the headrest assembly 16. In addition, the headrest assembly 16 includes an upper back support 44 which is movable laterally along the slide member 34 and guide bar 36.

Figure 3:
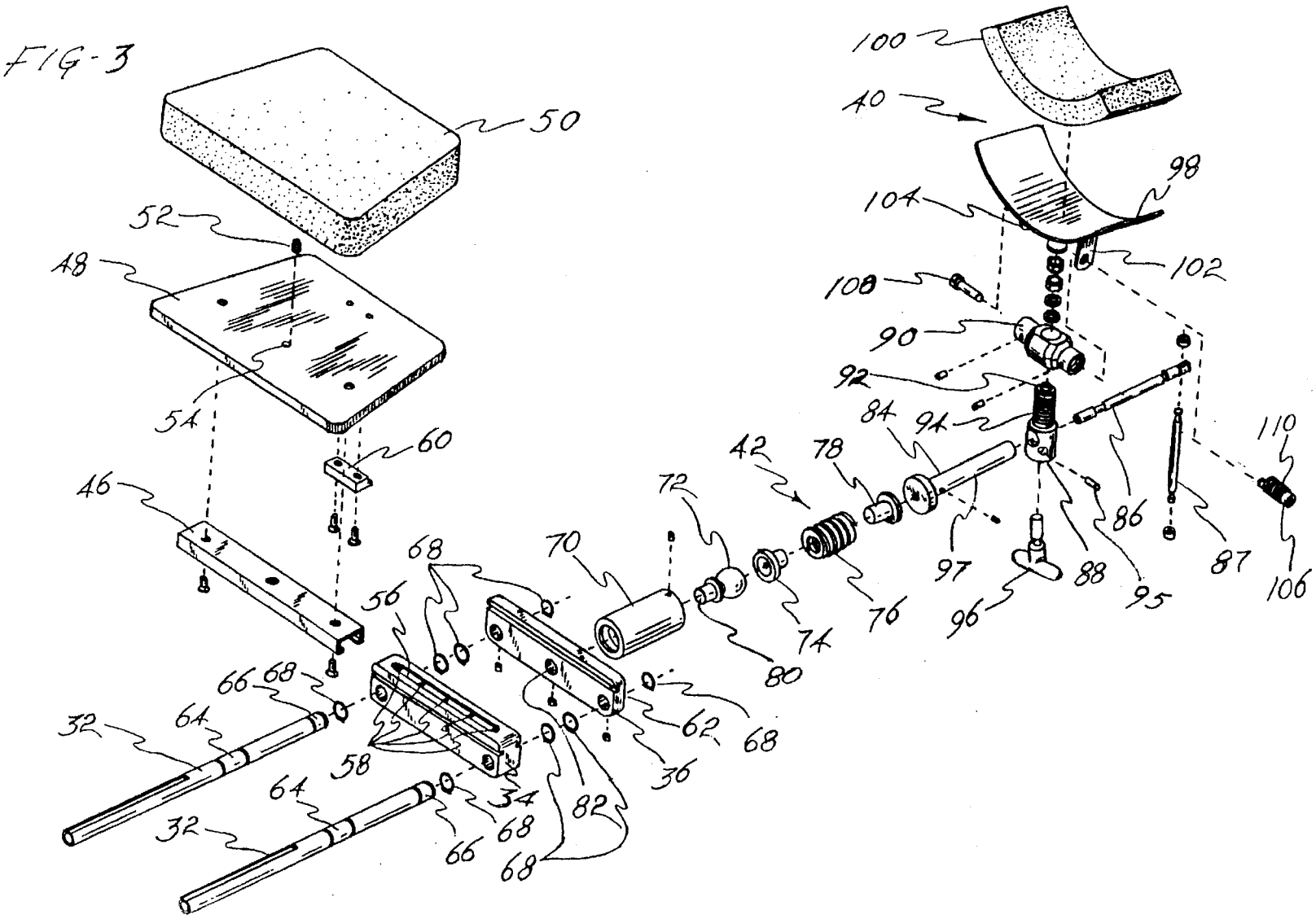
FIG. 3 is an exploded perspective view of the headrest assembly for the attachment.

Referring to FIG. 3, an exploded view of the headrest assembly 16 is shown. As seen in this view, the headrest assembly 16 further includes a C-channel 46 which is guided by and slidably engaged with the slide member 34. The C-channel 46 is attached to an upper backboard 48 of the upper back support 44, and an upper back cushion 50 is supported on the upper backboard 48. A spring plunger 52 is threadably engaged through an aperture 54 of the backboard 48 and extends into a channel 56 formed in the guide member 34. The plunger 52 includes a resiliently biased end member for engaging in one of a plurality of detents 58 formed in the channel 56 whereby the upper back support 44 will be positively positioned in one of five pre-selected lateral locations relative to the upper frame 30. To further facilitate guiding the upper back support 44 in its lateral movement, a guide block 60 is attached to an upper end of the backboard 48 for engagement with a channel 62 of the guide bar 36.

The adjustment assembly 42 includes a ball joint case 70 containing a ball joint ball 72, a ball grip 74, a compression spring 76 and a compression plunger 78. The end 80 of the ball 72 extends from the casing 70 and is engaged with a central aperture 82 of the guide bar 36 whereby the adjustment assembly 42 is mounted to the upper frame 30.

A slide weldment 84 is attached to an end of the casing 70, and a ball joint bolt 86 extends through the weldment 84 into engagement with the compression plunger 78 wherein rotation of the bolt 86 by a handle 87 causes the ball grip 74 to lock the ball 72 into firm engagement with the casing 70 whereby a selected angular relationship between the ball 72 and casing 70 may be obtained. In this manner, the headrest 40 may be positioned in an infinite number of positions forwardly and rearwardly, as well as laterally side to side.

The headrest 40 is mounted to the weldment 84 by means of a headrest clamp 88 through which the weldment 84 passes. A headrest pivot 90 is mounted on top of the clamp 88 and is rotatably movable about an axis of an upper end 92 of the clamp 88. Further, a Belleville assembly 94 provides a preset resistance to the rotational movement of the pivot 90 such that a predetermined force is required to pivot the headrest about the clamp 88.

It should be noted that the clamp 88 is also mounted for longitudinal movement along the weldment 84. In addition, a pin 95 is provided through the clamp 88 for engaging a flat portion 97 on the weldment 84 to prevent pivotal movement of the clamp 88 about the weldment 84. The clamp 88 may be locked into a desired position on the weldment 84 by means of a T-handle 96 threadably engaged through the clamp 88 into engagement with the weldment 84.

The headrest 40 includes a headrest weldment 98 and a cushion 100 mounted to the weldment 98. The weldment 98 includes a pair of rearwardly extending ears 102, 104 which are engaged by respective bolts 106, 108 attached to opposing ends of the headrest pivot 90. The headrest 40 is pivotal about the bolts 106, 108 and a Belleville assembly 110 is provided in association with one of the bolts 106 to ensure that a predetermined force is required to rotate the headrest 40.

Figure 4:
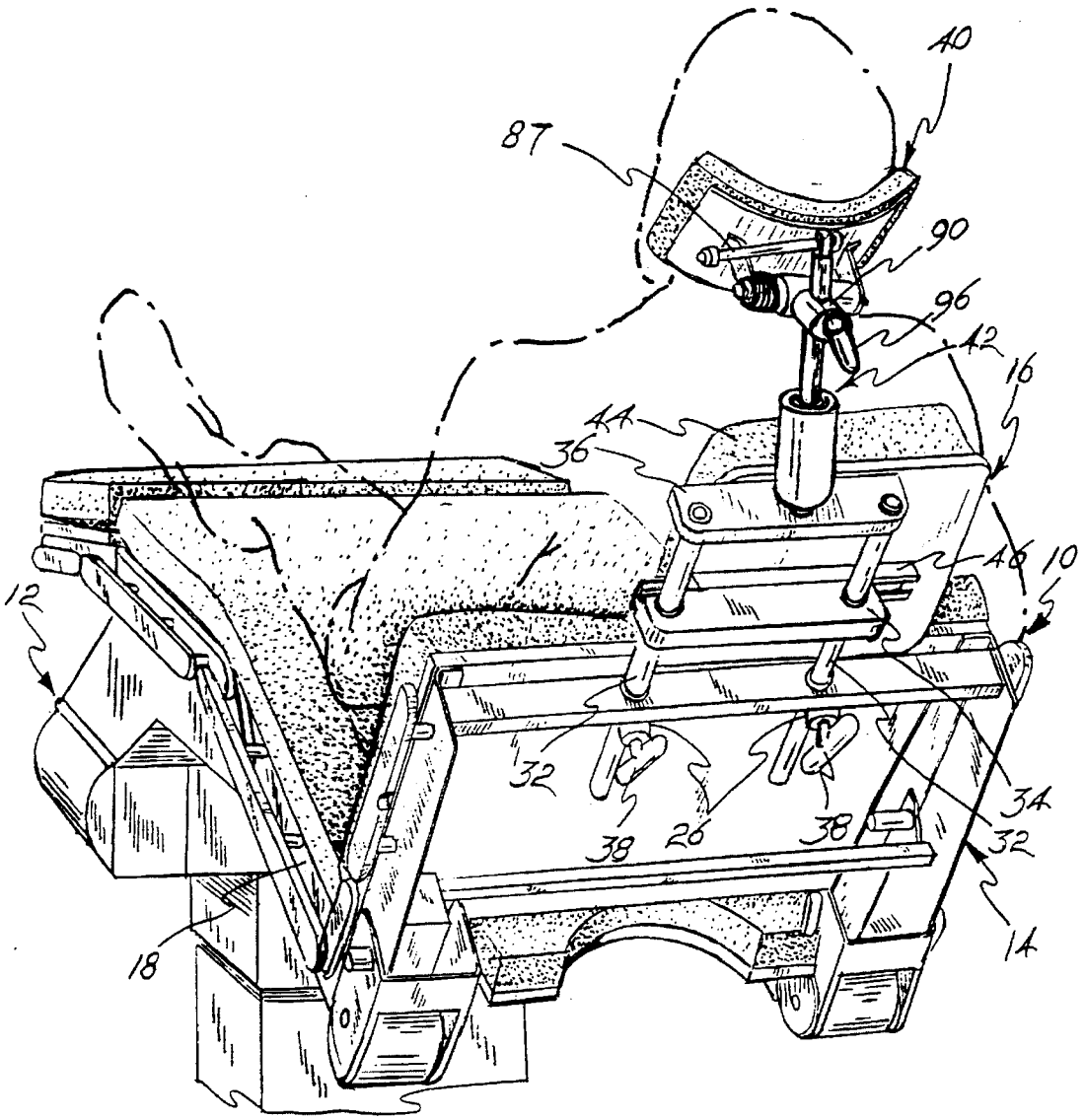
FIG. 4 is a perspective view illustrating the attachment mounted on a surgical table and in position for supporting a patient.

Referring to FIG. 4, the shoulder arthroscopy attachment 10 is shown attached to a surgical table 12 and is located in a typical position for supporting a patient. As can be seen, the lumbar support assembly 14 is attached to an end of the seat section 18 for the table and is located to support a lumber portion of a patient's back.

The frame 30 of the headrest assembly 16 is clamped in position in the sockets 26. It should be noted that the longitudinal position of the upper back support 44 and headrest 40 may be adjusted relative to the lumbar support assembly 14 by positioning the bars 32 of the headrest assembly 16 to a desired location within the sockets 26.

In addition, it can be seen that the headrest 40 has been manipulated to a desired position by forward pivoting of the adjustment assembly 42, as well as by locating the clamp 88 at a desired longitudinal position along the weldment 84.

The upper back support 44 is movable laterally relative to the frame 30 to one of two positions on either side of its center position, as provided by the detents 58 in the slide member 34. In this manner, one shoulder of a patient may be supported by the upper back support 44 while substantially exposing the other shoulder of the patient for surgery. As illustrated in FIG. 4, the upper back support 44 is movable to a position wherein a lateral edge of the support 44 is located adjacent to or inwardly from the lateral edge of the frame 30, as defined by the bars 32, such that the positioning of the support 44 operates to avoid interference of the cushion 44 with the desired access to the patient.

Thus, it should be apparent that the present shoulder arthroscopy attachment can be easily adjusted for patients of various heights and sizes, and provides improved access to a patient for a shoulder arthroscopy operation. Further, it can be seen that the present shoulder arthroscopy attachment may be used with an existing surgical table to thereby increase the utility of the surgical table for additional operations.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A shoulder arthroscopy attachment for use with a surgical table comprising:

a lumbar support assembly and a head rest assembly;

said lumbar support assembly including a lower frame for attachment to an end of a surgical table and a lumbar support mounted on said lower frame for supporting a lumbar portion of a patient;

said head rest assembly including an upper frame detachably mounted to said lower frame at a longitudinal end of said lower frame, an upper back support positioned over said upper frame and a head rest adjustably mounted to said upper frame at a longitudinal end of said upper frame; and wherein said upper back support is mounted for movement to a plurality of positions relative to said upper frame.

2. The attachment as recited in claim 1 wherein said upper back support is movable laterally along said upper frame to said plurality of positions.

3. The attachment as recited in claim 1 wherein said upper back support is mounted for sliding movement along said upper frame to said plurality of positions.

4. The attachment as recited in claim 1 wherein said upper frame comprises opposing lateral edges and said upper back support is movable to a position extending beyond at least one of said lateral edges whereby a shoulder of a patient adjacent the lateral edge opposite from said at least one lateral edge is exposed for a surgical operation.

5. The attachment as recited in claim 1 wherein said head rest is movable in a front to rear and a lateral side to side direction relative to said upper frame.

6. A shoulder arthroscopy attachment in combination with a surgical table having a removable leg section comprising:

a table seat section having a receptacle portion for receiving a table leg section;

an attachment attached to said receptacle portion in place of said table leg section; and wherein said attachment includes a support for supporting a portion of a patient's back, said support being mounted for movement to expose at least one of said patient's shoulders for a shoulder arthroscopy operation.

7. The apparatus as recited in claim 6 wherein said support is movable to laterally opposed sides to expose either shoulder of the patient.

8. The apparatus as recited in claim 7 wherein said attachment includes a frame having opposed lateral edges and said support is movable to position each of said sides adjacent to a respective one of said edges.

9. The apparatus as recited in claim 6 wherein said attachment comprises a lumbar support including an attachment portion for engaging said receptacle portion and a head rest assembly mounted on said lumbar support.

10. The apparatus as recited in claim 9 wherein said head rest assembly includes said support for supporting a portion of a patient's back and a head rest mounted adjacent to an end of said support.

11. The apparatus as recited in claim 9 wherein said head rest assembly includes a frame including opposing bar members and said lumbar support includes sockets for receiving said opposing bar members.

12. A shoulder arthroscopy attachment comprising:

a frame;

an upper back support mounted on said frame for supporting an upper back portion of a patient;

a head rest mounted on said frame for supporting a head of a patient; and wherein said upper back support is supported for movement relative to said frame to selectively expose a shoulder of a patient for a shoulder arthroscopy operation, said upper back support remaining attached to said frame during said movement of said upper back support.

13. The attachment as recited in claim 12 wherein said upper back support is mounted for sliding movement in a lateral direction.

14. The attachment as recited in claim 13 including a guide member attached to said frame for guiding said upper back support in sliding movement, said guide member extending across a width of said frame.

15. The attachment as recited in claim 12 including a lumbar support, said frame mounted to said lumbar support.

16. The attachment as recited in claim 15 wherein said frame is mounted for movement in a longitudinal direction relative to said lumbar support.

17. The attachment as recited in claim 15 wherein said lumbar support includes means for detachably mounting said lumbar support to a surgical table.

* * * * *

UNITED STATES PATENT AND TRADEMARK OFFICE

CERTIFICATE OF CORRECTION

PATENT NO. : 5,661,859

DATED : September 2, 1997

INVENTOR(S) : James A. Schaefer

It is certified that error appears in the above-indentified patent and that said Letters Patent is hereby corrected as shown below:

On the title page, item [54] and column 1, line 2,

The word "Arthoscopy" in the title should be spelled "Arthroscopy".

Signed and Sealed this

Eleventh Day of November, 1997

*Attest:*

*Attesting Officer*

BRUCE LEHMAN

*Commissioner of Patents and Trademarks*